US011791531B2

(12) United States Patent
Facco et al.

(10) Patent No.: US 11,791,531 B2
(45) Date of Patent: Oct. 17, 2023

(54) ELECTRONIC POWER DIVIDER FOR RF-SIGNALS AND ELECTRONIC RF-SIGNAL TRANSCEIVER SYSTEM COMPRISING SUCH DEVICE

(71) Applicant: Adant Technologies, Inc., Wilmington, DE (US)

(72) Inventors: Mauro Facco, Santa Giustina in Colle (IT); Francesco Donzelli, Ponte San Nicolò (IT); Daniele Piazza, Padua (IT)

( * ) Notice: Subject to any disclaimer, the term of this patent is extended or adjusted under 35 U.S.C. 154(b) by 172 days.

(21) Appl. No.: 17/296,890

(22) PCT Filed: Nov. 26, 2019

(86) PCT No.: PCT/IB2019/060188
§ 371 (c)(1),
(2) Date: May 25, 2021

(87) PCT Pub. No.: WO2020/110001
PCT Pub. Date: Jun. 4, 2020

(65) Prior Publication Data

US 2022/0029268 A1 Jan. 27, 2022

(30) Foreign Application Priority Data

Nov. 27, 2018 (IT) ..... 102018000010632

(51) Int. Cl.
*H01Q 3/24* (2006.01)
*H01P 5/16* (2006.01)
*H01P 5/19* (2006.01)

(52) U.S. Cl.
CPC ..... *H01P 5/19* (2013.01); *H01Q 3/247* (2013.01)

(58) Field of Classification Search
CPC ..... H01Q 3/24; H01Q 3/247; H01Q 13/08; H01Q 1/50; H01Q 21/00; H01P 5/16; H01P 5/19; H01P 5/08; H03H 7/48
See application file for complete search history.

(56) References Cited

U.S. PATENT DOCUMENTS 3,091,743 A * 5/1963 Wilkinson ..... H01P 5/16 333/127
5,408,204 A * 4/1995 Feldle ..... H03G 11/025 333/17.2

(Continued)

FOREIGN PATENT DOCUMENTS

EP 1898523 3/2008

OTHER PUBLICATIONS

Kalis A et al: "A power divider/combiner block for switched beam arrays", Industrial Electronics 2002. Proceedings of the 2002 IEEE International Symposium on Jul. 8-11, 2002, Piscataway, NJ, USA, IEEE, vol. 1. Jul. 8, 2002, pp. 89-92 Figs. 1, 2; Section III.

*Primary Examiner* — Tho G Phan
(74) *Attorney, Agent, or Firm* — Themis Law

(57) ABSTRACT

An electronic power divider for radio frequency signals, and an electronic system containing such electronic power divider, includes one or more inputs designed to be fed by an electromagnetic radio frequency signal having a predetermined wavelength; at least two outputs for the radio frequency signal, each of which is connected to the same input; electric paths adapted to connect each output to the corresponding input, and a system of selective variation of the electric impedance associated with each of the electric paths during the passage of the signal. The impedance variation system is adapted to vary the impedance associated with the paths discreetly between a lower and an upper value, and to simultaneously maintain the value of the (Continued)

impedance associated with two or more paths at least at the lower value.

13 Claims, 6 Drawing Sheets

(56) References Cited

U.S. PATENT DOCUMENTS

| | | | | |
|---|---|---|---|---|
| 5,754,082 | A * | 5/1998 | Swanson | H03H 7/487 333/100 |
| 5,767,755 | A * | 6/1998 | Kim | H01P 1/10 333/101 |
| 6,545,564 | B1 * | 4/2003 | Coppola | H03H 7/48 333/124 |
| 9,712,133 | B2 | 7/2017 | Bianchi | |
| 10,062,971 | B2 * | 8/2018 | Mössinger | H01Q 21/0006 |
| 10,483,612 | B2 * | 11/2019 | Chen | H01P 5/19 |
| 2022/0416395 | A1 * | 12/2022 | Lin | H01P 5/16 |

* cited by examiner

ELECTRONIC POWER DIVIDER FOR RF-SIGNALS AND ELECTRONIC RF-SIGNAL TRANSCEIVER SYSTEM COMPRISING SUCH DEVICE

FIELD OF APPLICATION OF THE INVENTION

The present invention can be applied in the technical field of electronic devices for the transmission of radio frequency signals and it concerns an electronic power divider for radio frequency signals.

Moreover, a further subject of the invention is an electronic system for transmitting and receiving electromagnetic signals using this electronic power divider.

STATE OF THE ART

As is known, in the technical sector of radio frequency electronic devices are often required which must have a predetermined impedance selected in such a way as to establish a condition of maximum signal power transfer with respect to the equipment positioned downstream.

In several different applications it is necessary to split the electromagnetic signal coming from a single input (or from a single line) into a plurality of signals suited to feed corresponding active or passive equipment (for example, antennas, amplifiers, adapters etc.).

As required by the known radio frequency theory, in order to ensure the maximum signal power transfer over the entire cascade of equipment, it is convenient to maintain the impedance matching condition between all the outputs of a piece of equipment located upstream and the inputs of the pieces of equipment located downstream.

In general, the characteristic impedances which are used more frequently in the sector of radio frequency are usually included between 10 Ohm and 300 Ohm.

The known technique provides a plurality of devices designed to split a single electromagnetic signal on several outputs while at the same time maintaining the impedance of said outputs substantially constant and adapted.

Devices of this type are used, for example, in the sector of television broadcasting to divide digital audio/video signals (es. DVB-S) and are also used in the sector of communications to divide the signals used in mobile telephony that fall within the GSM or UMTS band.

The sector of data transmission and reception through WiFi technology is particularly important nowadays and in WiFi technology radio frequency signals with band included between 2.4 GHz and 5 GHz are mainly used.

Recent developments in this field have led to the creation of antenna systems, the so-called smart devices, which are capable of varying their frequency behaviour according to the operating conditions or to specific technical needs imposed by the system located upstream or downstream.

More specifically, WiFi devices are known, which are provided with a plurality of antennas intended to be selectively activated/deactivated in such a way as to modify the radiation pattern of the device according to the frequency of the transmitted or received electromagnetic signal.

These antenna systems are provided with an electronic control circuit which is configured to selectively feed one or more antennas of the same type designed to radiate and receive electromagnetic frequency signals (and the related wavelength) included within a predefined band.

For example, it is possible to prepare a group constituted by two or more antennas (equal to or different from one another) which can be activated individually (or jointly) while the remaining antennas are deactivated.

The selective activation of the antennas (according to this smartmode) will make it possible to considerably vary the overall radiation pattern of the apparatus, for example passing from a pattern of the directional type to a pattern of the omnidirectional type.

To selectively feed the antennas with an electromagnetic signal with convenient wavelength, power dividers of the type described above are often used, which make it possible to carry out a power matching between the signal input and the various antennas.

However, in this type of applications the main drawback posed by this solution lies in that the power dividers are designed to activate the outputs in a mutually exclusive manner.

In other words, these devices make it possible to activate only one output at a time while, in the same moment, all the remaining outputs are interdicted.

This limitation introduced by power dividers makes it particularly difficult to design antenna systems of the smart-type using a plurality of antennas.

More specifically, the design of smart antenna systems is rather complex, since it is necessary to use a plurality of power dividers connected to one another in such a way as to allow the multiple activation of the antennas.

Therefore, the cost of these smart systems is negatively affected by the design complexity introduced by the intrinsic limitations to which the individual power dividers are subjected.

A further drawback of this solution lies in that the overall flexibility of the antenna systems using the power dividers described above is rather limited and unable to meet the market needs in terms of versatility and efficiency.

Another, yet not less important drawback of this solution is represented by the fact that the smart antenna systems provided with said power dividers have rather large overall dimensions, which make it difficult to miniaturize the circuits.

The patent documents EP 1 898 523 and U.S. Pat. No. 9,712,133 and the scientific publication "A power divider/combiner block for switched beam arrays"/Kalis A. et Al. describe electronic power divider devices and/or systems provided with corresponding inputs/outputs for radio frequency signals and means for impedance variation associated with the electric paths that connect these inputs to the outputs. However, also these devices/systems pose the same drawbacks as those mentioned in the documents described above.

PRESENTATION OF THE INVENTION

The present invention intends to overcome the drawbacks mentioned above by providing an innovative electronic power divider for radio frequency signals.

More specifically, the main object of the present invention is to provide an electronic power divider which makes it possible to maintain one or more outputs simultaneously activated or deactivated in the same instant.

In other words, the device which is the subject of the present invention allows the multiple and independent activation of several outputs in the same time instant.

More specifically, an electronic power divider for a radio frequency signal according to the present invention having N outputs will be suited to enable the activation of the outputs based on the following combinations:

$$\binom{N}{N}+\binom{N}{N\quad 1}+\binom{N}{N\quad 2}+\ +\binom{N}{1}$$

It is a further object of the present invention to provide an electronic power divider for an electromagnetic signal which makes it possible to obtain highly flexible apparatuses or systems that can easily adapt to the various uses for which they are designed.

Again, it is a further object of the present invention to provide an electronic power divider for an electromagnetic signal which is relatively inexpensive and can be produced in a particularly simple and quick manner.

It is a non-secondary object of the present invention to provide an electronic power divider for an electromagnetic signal which makes it possible to establish an impedance matching condition (and a maximum signal power transfer) with the devices which are connected downstream of the same.

It is another, yet not the least object of the present invention to provide an electronic power divider for an electromagnetic signal which is particularly compact and light and which can be used in systems or apparatuses with particularly reduced sizes.

These objects are achieved by an electronic power divider for an electromagnetic signal according to claim 1.

Other objects that are described in greater detail below are achieved by an electronic power divider for an electromagnetic signal according to the dependent claims from 1 to 12.

The subject of the invention includes also an electronic system for transmitting and receiving electromagnetic signals according to claim 13.

BRIEF DESCRIPTION OF THE DRAWINGS

The advantages and characteristics of the present invention will clearly emerge from the following detailed description of some preferred but non-limiting configurations of an electronic power divider for an electromagnetic signal, with special reference to the following drawings.

DETAILED DESCRIPTION OF THE INVENTION

Figure 1:
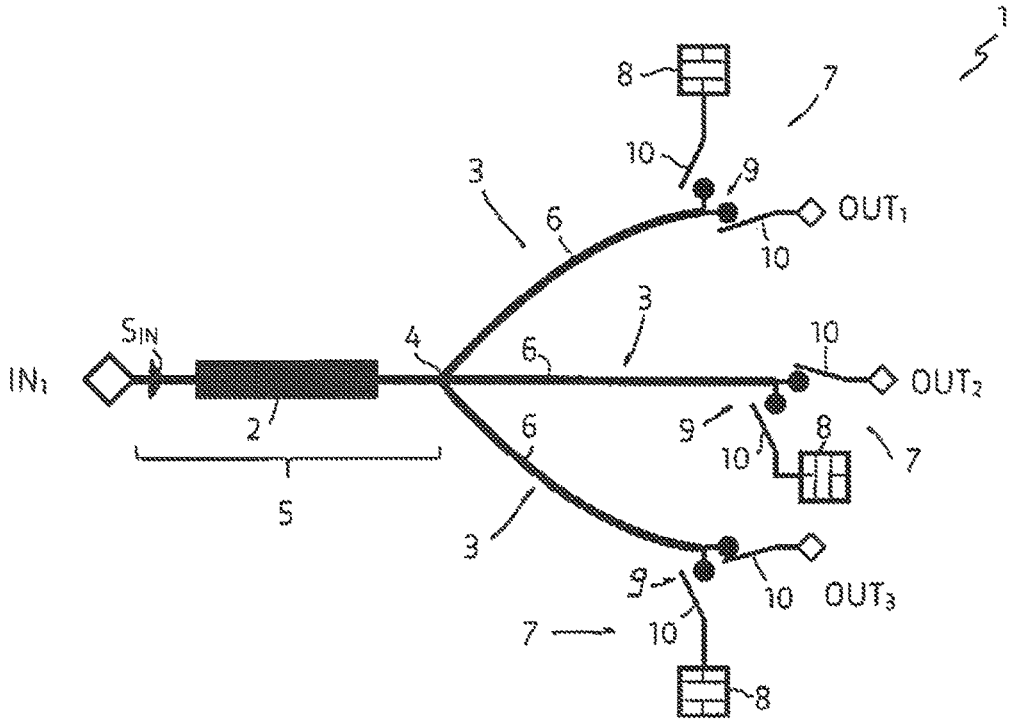
FIGS. 1 to 6 show simplified circuit diagrams of respective configurations of an electronic power divider for radio frequency signals according to the invention.

The subject of the present invention is an electronic power divider for an electromagnetic signal, indicated as a whole by the reference numeral 1 in the Figures.

Power dividing electronic circuits are used in many types of applications for transferring an electric signal from an input port to one or more output ports.

The power dividers which are the subject of the present invention are configured to operate with an electromagnetic signal S having a predetermined wavelength λ, generally selected within the radio frequency band.

More specifically, the signals S used in the power dividers 1 illustrated in the Figures can have a wavelength λ included between 1 mm and 1 Km or, alternatively, a frequency f included between 300 KHz and 300 GHz.

The power dividers 1 described below are capable of dividing a signal $S_{IN}$ applied to the input IN with predetermined shape, wavelength λ and power P into one or more output signals $S_{OUT}$ having the same shape and wavelength as the input signal but a power P' different from the power of the latter.

In most cases the power dividers 1 are of the passive type, meaning that the power P' of the output signal $S_{OUT}$ is lower than the power P of the input signal $S_{IN}$.

It cannot be excluded, however, that the device 1 which is the subject of the present invention may be of the active type, meaning capable of allowing an output signal $S_{OUT}$ to be obtained whose power P' is higher than the power P associated with the input signal $S_{IN}$.

In this case, therefore, inside the device 1 there will be one or more RF amplifier stages, the design of which will not be dealt with in the following part of the present description, since the design of these circuits has been well-known for a while in the sector of electronics.

Furthermore, also the technique for the impedance matching of the cascade of apparatuses intended to process an electromagnetic signal has been known for a while in the sector of radio frequency and will not be dealt with in the following part of the description.

The expression "impedance matching" means the ability of a chain of electronic circuits to obtain the maximum power transfer associated with a signal S that propagates from an upstream stage towards one or more downstream stages.

As is known, indicating the output impedance of stage N (upstream) with $Z_N$ and the input impedance of stage N+1 (downstream) with $Z_{N+1}$, the maximum signal power transfer is obtained when the modules of those impedances satisfy the following equation:

$$|Z_N|=|Z_{N+1}|$$

Furthermore, in most cases, the impedance of the chain of devices must be adapted to the characteristic impedance of the load, which can be, for example, an antenna, a transmission line, a coaxial cable etc.

In general, the most common loads used in the radio frequency sector have a characteristic impedance $Z_0$ selected among the following values: 50 Ohm, 75 Ohm, 93 Ohm.

When designing radio frequency circuits, it is necessary to take in consideration several factors which may affect the value of the impedance associated with the inputs and/or the outputs, for example, electric and geometric factors that are related to the selection and arrangement of the components or to the development of the paths in which the electromagnetic signal S propagates.

More specifically, the impedance value at the input or output of the circuit varies according to the trend of the impedance associated with the electronic components installed on the circuit, to the width and length of the connection paths (or cables), to the materials used etc.

However, in this specific case it is natural to assume that the expert in the art, who is an electronic and radio frequency circuit designer, is able to apply the theoretical and practical design techniques usually employed in this technical context for the purpose of making a power divider circuit with respective input and output impedances equal to a predetermined characteristic value.

Figure 6:
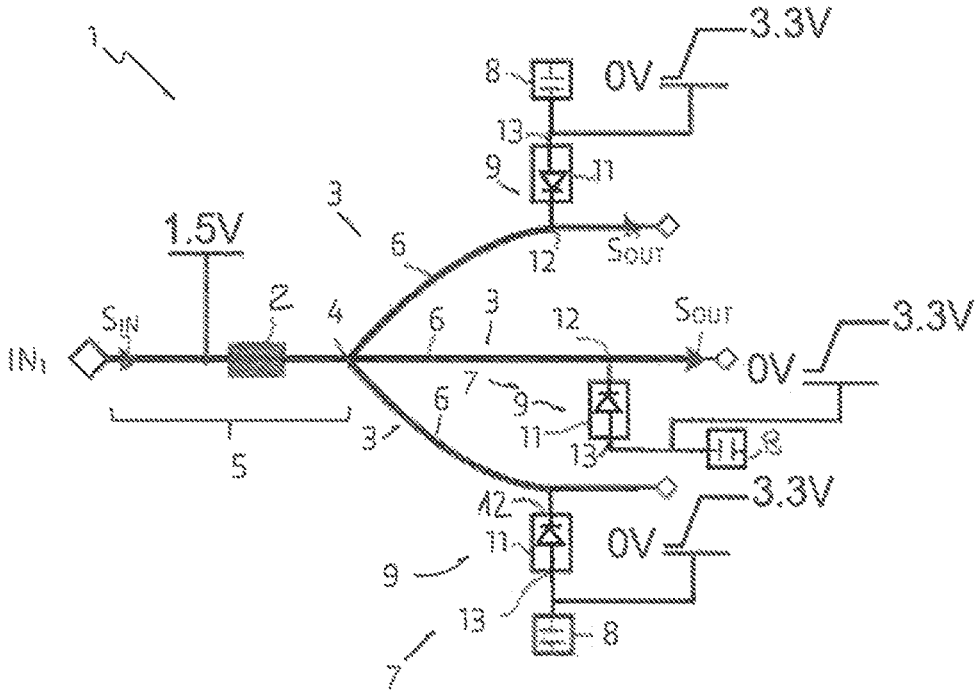
Figure 7A:
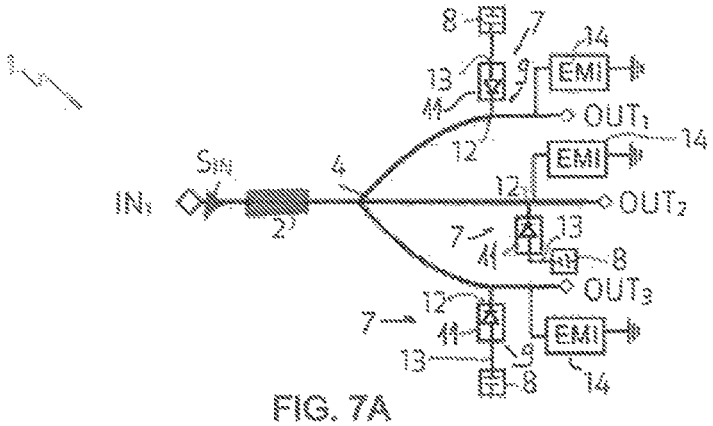
FIGS. 7A to 7C show respective simplified circuit diagrams of some circuits illustrated in FIGS. 1 to 6, to which an element has been applied that is suited to reduce the harmonic phenomena caused by the passage of the radio frequency signal.
Figure 7B:
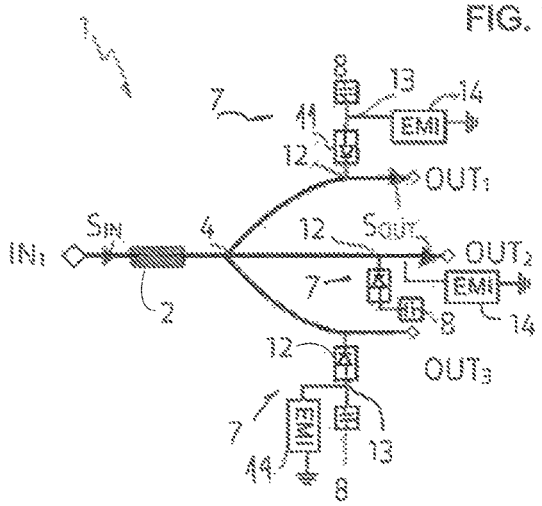
Figure 7C:
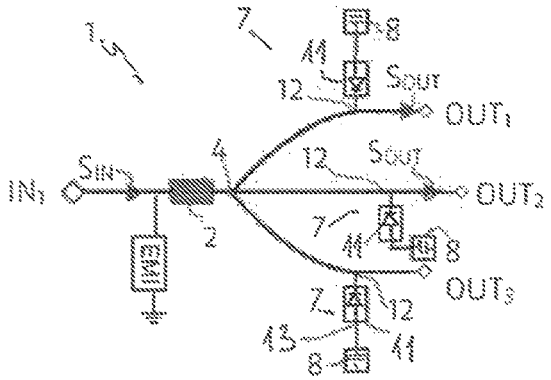
Figure 8:
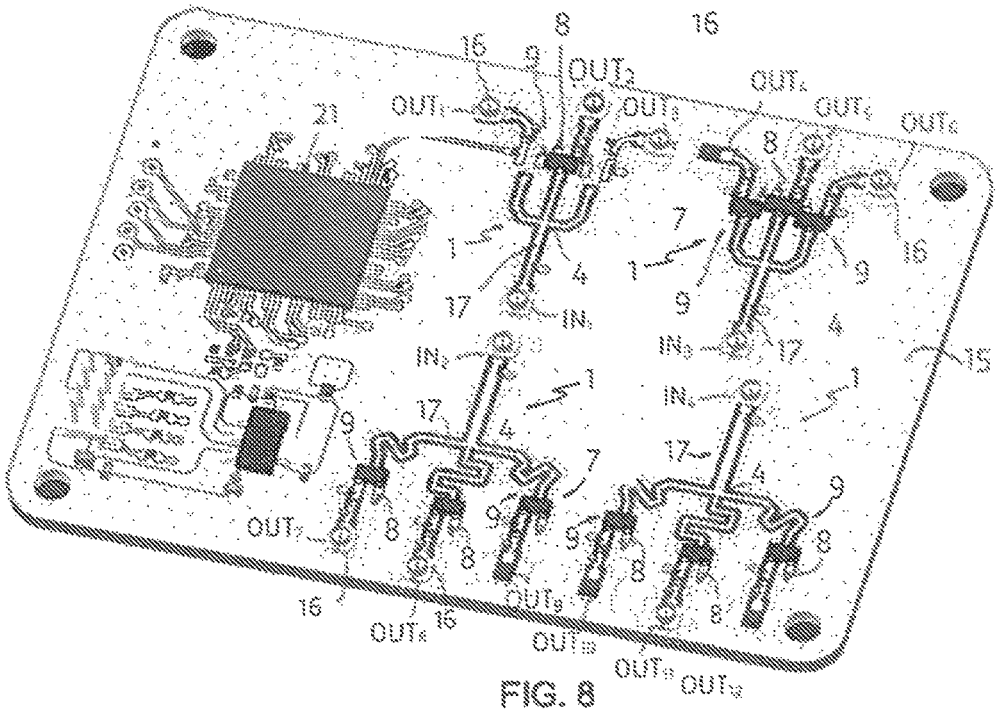
FIG. 8 shows a first example of embodiment of an electronic power divider of the type illustrated in the diagrams shown in FIGS. 1-6.
Figure 9:
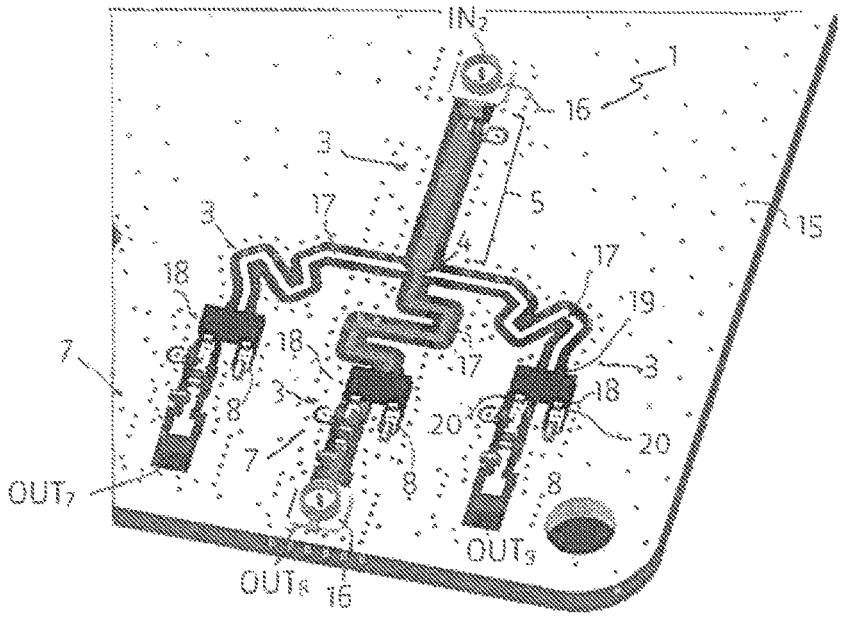
FIG. 9 shows an enlarged view of a detail of FIG. 8A.

FIGS. 1 to 7C show simplified circuit diagrams of the electronic power divider 1 according to the invention, while FIGS. 8 and 9 show a possible practical embodiment of said circuit.

In FIGS. 1 to 7C the impedance matching of the inputs/outputs at the characteristic project value is visually represented by a black rectangle indicated by the reference numeral 2.

This rectangle 2 schematically represents an impedance transformer obtained through discrete components and/or components distributed along the circuit and having the purpose of associating a characteristic impedance value $Z_0$ with the inputs IN and with the outputs OUT of the device 1.

The electronic power divider 1 according to the invention comprises one or more inputs $IN_1$, $IN_2$, $IN_3$, $IN_4$ intended to be fed by an electromagnetic signal $S_{IN}$ having a predetermined wavelength λ and at least two outputs $OUT_1$, $OUT_2$, $OUT_3$, which are connected to the same input $IN_1$ (or $IN_2$, or $IN_3$, or $IN_4$).

In the representation of the invention shown in FIGS. 1 to 7C it is possible to observe a power divider 1 having a single input $IN_1$ and three outputs $OUT_1$, $OUT_2$, $OUT_3$.

This configuration, however, is provided by way of example and presents a single input to which a variable number of outputs can be associated, and in any case a number not smaller than two.

Furthermore, as can be clearly seen in the circuit shown in FIGS. 8 and 9, the device may have several inputs (in this case, four), each one of which is associated with a predetermined group of outputs (in this case, three).

It is also possible to define a respective electric path 3 suited to connect each individual output $OUT_1$, $OUT_2$, $OUT_3$ to the corresponding input $IN_1$.

As better illustrated in the diagrams shown in FIGS. 1 to 7C, the electric paths 3 may comprise a common connection point 4 electrically connected to the corresponding input $IN_1$.

Therefore, the electric paths 3 may comprise a first common section 5 with its ends connected to the input $IN_1$ and to the common point 4 and a plurality of branches 6, each one of which has its ends respectively connected to the common point 4 and to the corresponding output $OUT_1$, $OUT_2$, $OUT_3$.

The device 1 furthermore comprises means 7 for the selective variation of the electric impedance Z associated with each electric path 3 during the passage of the electromagnetic signal S.

More specifically, these means 7 make it possible to vary the impedance Z associated with each single output $OUT_1$, $OUT_2$, $OUT_3$ and are configured to vary this value exclusively between two discrete and distinct values, a lower one $Z_{MIN}$ and an upper one $Z_{MAX}$.

These means 7 are thus configured to bring the impedance Z associated with a corresponding output only to the lower value $Z_{MIN}$ or to the upper value $Z_{MAX}$, while they do not allow it to be fixed at intermediate values included between the lower value $Z_{MIN}$ and the upper value $Z_{MAX}$.

These means 7 make it possible to vary the value of the impedance Z associated with the respective outputs $OUT_1$, $OUT_2$, $OUT_3$ in an independent manner, more specifically the instant variation of the impedance Z associated with an individual output $OUT_1$ will not cause any variation of the value of the impedance Z associated with the remaining outputs $OUT_2$, $OUT_3$ in the same instant.

Conveniently, the discrete lower value $Z_{MIN}$ of the impedance that can be associated with each individual output $OUT_1$, $OUT_2$, $OUT_3$ can be substantially equal to the characteristic value of the load $Z_0$, in such a way as to satisfy with it the condition of maximum power transfer.

For example, as already described above, the lower value $Z_{MIN}$ of the impedance can be equal to 50 Ohm, 75 Ohm or 93 Ohm.

Preferably, the upper value $Z_{MAX}$ of the impedance will be considerably higher than the lower value $Z_{MIN}$ and, more specifically, it can be a multiple of the latter.

This situation, therefore, can be expressed with the following formula:

$$Z_{MAX} \geq M * Z_{MIN}$$

where M is an integer greater than 100 and preferably not less than 1000.

In this way, in the condition of maximum value of the impedance $Z_{MAX}$ the impedance variation means 7 are configured to simulate a substantially theoretical situation in which the impedance has an infinite value.

When one or more inputs $OUT_1$, $OUT_2$, $OUT_3$ are in the condition of maximum impedance ($Z_{MAX}$), the current flowing in the corresponding electric path 3 will substantially be null.

When this condition occurs, the signal S applied to the input $IN_1$ cannot propagate towards the corresponding output $OUT_1$, $OUT_2$, $OUT_3$, since the high value of the impedance $Z_{MAX}$ actually makes it possible to simulate an open electric path 3.

The electric current that is generated due to the effect of the application of the electromagnetic signal S to the input $IN_1$ will thus flow exclusively along the paths 3 having an impedance value equal to the minimum $Z_{MIN}$ (if present).

Conveniently, the means 7 for the selective impedance variation are suited to associate the upper value $Z_{MAX}$ of the impedance in the same instant with a single output at a time, with some outputs or with all of the outputs.

Consequently, the impedance variation means 7 are thus suited to promote, in the same time instant, the selective interdiction (open circuit) of one, some or all of the electric paths 3.

Preferably, as is better clarified below, the means 7 for the selective impedance variation can be configured to bring the impedance value associated with one or more outputs $OUT_1$, $OUT_2$, $OUT_3$ to the upper value $Z_{MAX}$ through the modification of the electromagnetic behaviour of said paths 3.

In this specific condition, the impedance variation means 7 are suited to reproduce the electromagnetic behaviour that the corresponding electric path 3 would have if it was inserted in a (fictitious) section of the transmission line at the common point 5.

The impedance variation means 7 can, for example, be configured to reproduce the behaviour of a quarter-wave stub (λ/4) applied at the common point 5.

More specifically, these means are suited to simulate a quarter-wave stub with respect to the wavelength λ of the electromagnetic signal S applied to the input $IN_1$ of the device.

As better illustrated in FIGS. 1 to 7C, the means for the selective impedance variation can reproduce the effect of a quarter-wave stub through the use of a capacitor 8 and of a switching element 9.

More specifically, the capacitor 8 can be connected in parallel with respect to the common point 4 while the switching element 9 will be suited to promote the selective connection of the common point 4 respectively to the capacitor 8 or to the given output $OUT_1$, $OUT_2$, $OUT_3$.

This condition is represented in the general diagram shown in FIG. 1, where the switching element 9 is schematically represented by means of one pair of complementary contacts 10 (when one of the two contacts is open the other is closed, and vice versa), which are associated with the corresponding output $OUT_1$, $OUT_2$, $OUT_3$ and with the capacitor 8.

In this way, the impedance variation means 7 can selectively control the condition of the individual pairs of contacts 10, in such a way as to promote the selective connection of the common point 4 to the output $OUT_1$, $OUT_2$, $OUT_3$ or to the capacitor 8.

When the contact 10 associated with the output $OUT_1$, $OUT_2$, $OUT_3$ is closed (and the contact associated with the capacitor is open) the impedance associated with the electric path 3 is equal to the lower value $Z_{MIN}$.

When the contact 10 associated with the capacitor 8 is closed (and the contact associated with the capacitor 9 is open) the electric path 3 between the input $IN_1$ and the output $OUT_1$, $OUT_2$, $OUT_3$ is substantially interdicted and the impedance value is equal to the upper value $Z_{MAX}$.

As already mentioned above, to create the condition of maximum impedance $Z_{MAX}$ the capacitor selectively connected to the common point must have a predetermined capacity value C selected in such a way as to reproduce the behaviour of a quarter-wave stub.

For example, according to the calculations made during the theoretical circuit simulations carried out on a power divider according to the invention, the capacity C of the capacitor 8 can be included between 0.2 pF and 100 nF.

Figure 2:
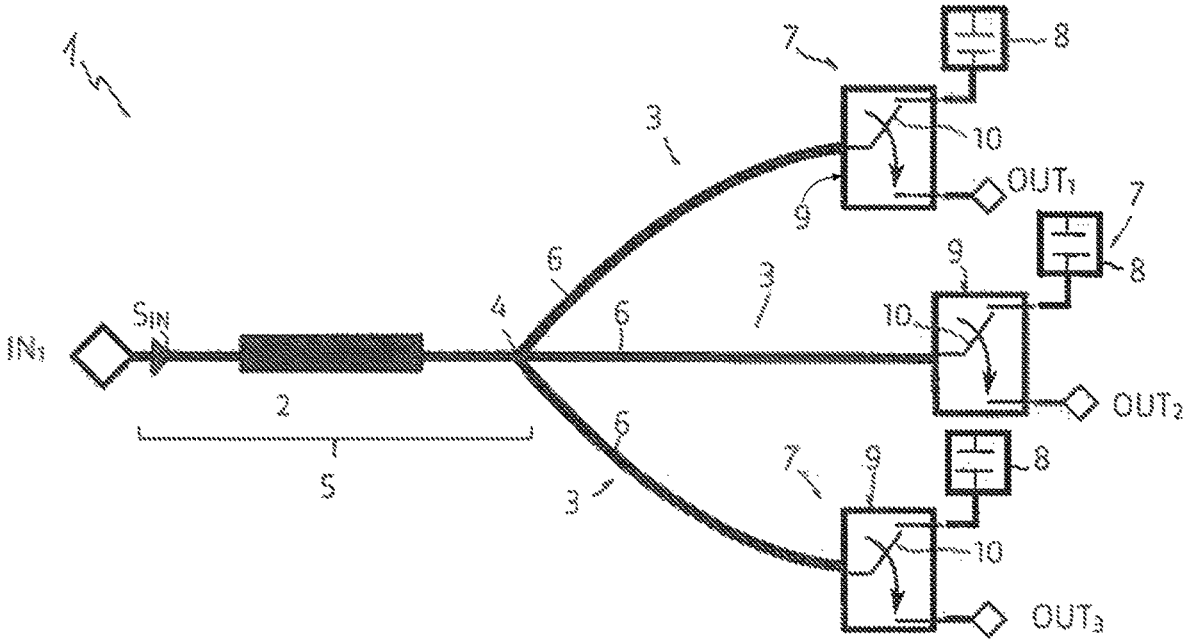

FIG. 2 shows an upgrade of the device shown in FIG. 1.

In this case, the switching element 9 is constituted by a SPDT (single pole, double throw) circuit suited to connect the common point 4 to the capacitor 8 or to the output $OUT_1$, $OUT_2$, $OUT_3$ in a mutually exclusive manner.

The SPDT circuit comprises a plurality of transistors made with MOS technology and therefore has particularly low polarization currents that considerably reduce the static power consumption of the device 1.

Furthermore, the MOS technology has low harmonic distortion and this makes it possible to produce a power divider 1 with reduced generation of spurious harmonic components which may disturb the electromagnetic radio frequency signal S.

In this case, the value of the capacity C of the capacitor 8 is calculated in such a way as to compensate for the reactive parasitic load introduced by the SPDT circuit, so as to simulate the behaviour of a quarter-wave stub when the capacitor 8 is connected to the common point 4.

By way of example, in this configuration of the device 1 the integrated circuit SKY13370 produced by Skyworks Solutions Inc. can be used as SPDT element.

Figure 3:
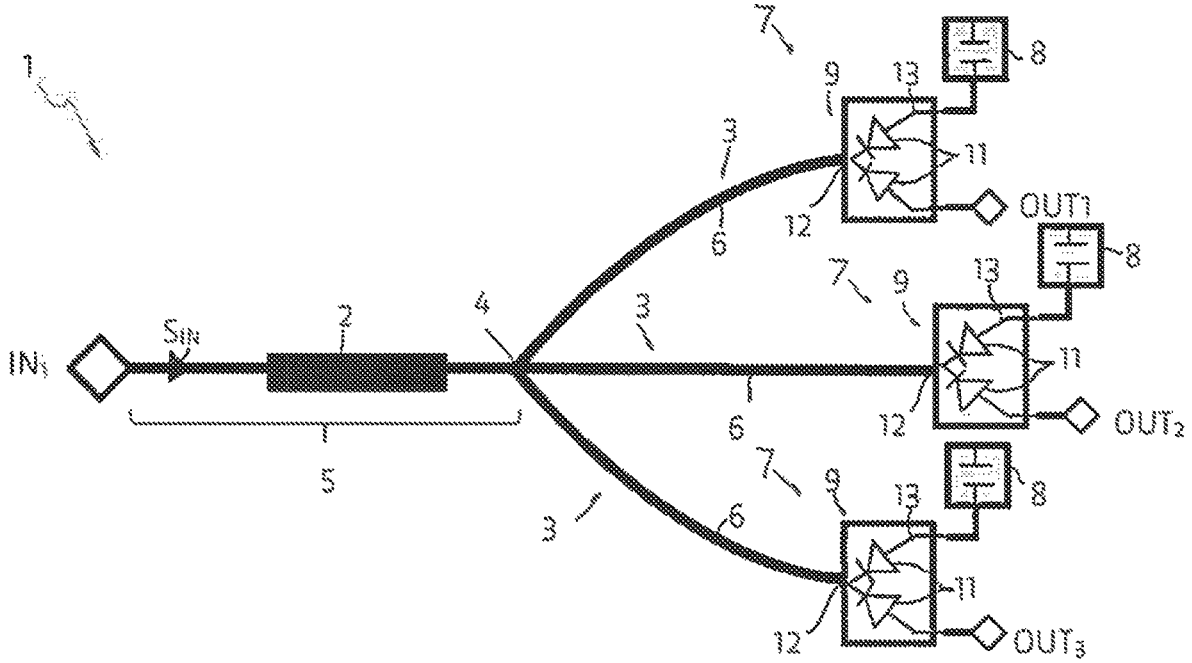
Figure 4:
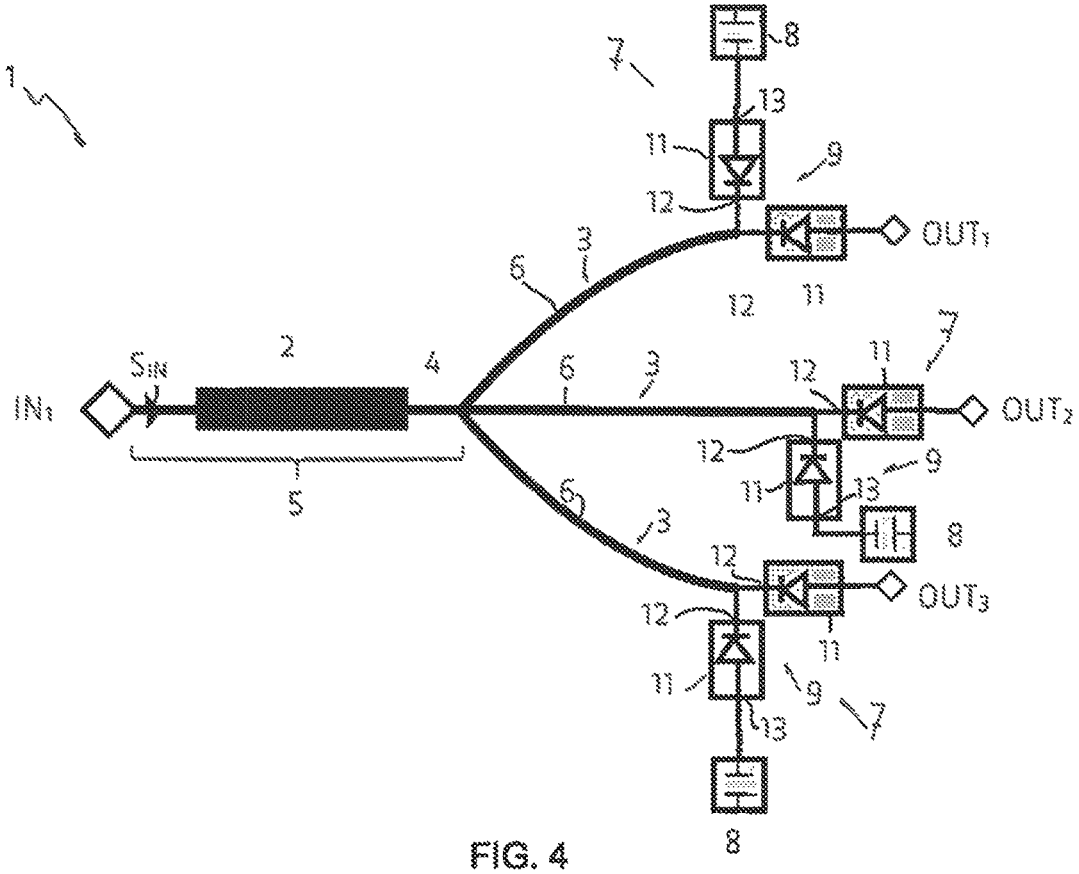
Figure 5:
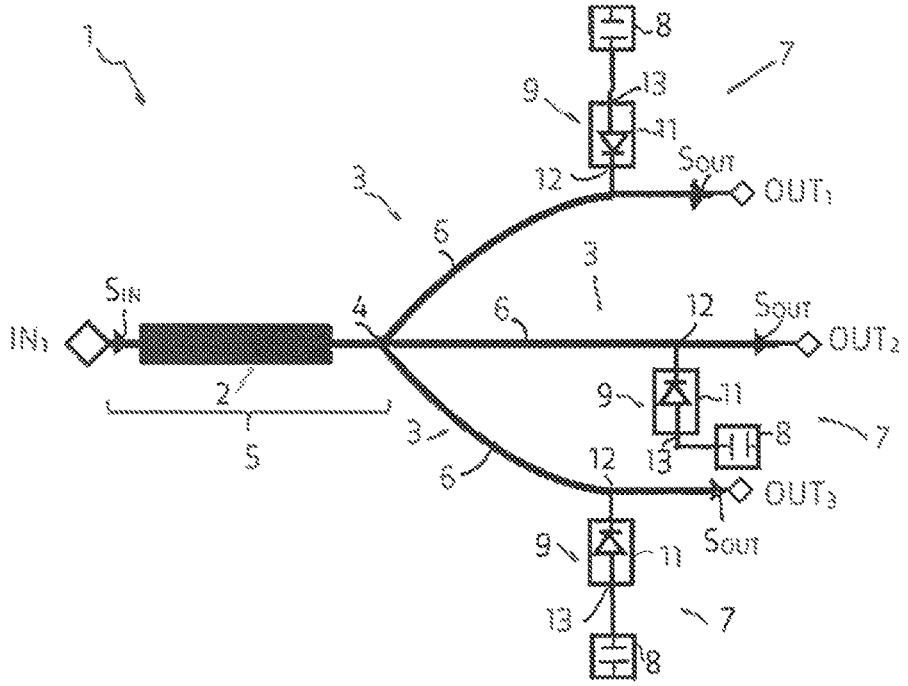

FIGS. 3 to 5 show an alternative embodiment of the device with respect to what is schematically shown in the diagram of FIG. 2.

In this case, the switching element is obtained through one or more diodes 11.

For example, in the circuit shown in FIG. 3 the switching element 9 is constituted by a pair of diodes 11 arranged inside a single component (or package).

The diodes 11 are connected in parallel and have the cathode 12 connected to the common point 4.

Furthermore, a diode 11 of the pair is connected in series to the output $OUT_1$, $OUT_2$, $OUT_3$, while the other diode 11 of the same pair is connected in series to the capacitor 8 to define with the latter, in the conductive state, a quarter-wave stub.

Even in this case the value of the capacity C of the capacitor 8 is calculated in such a way as to compensate for the reactive parasitic load introduced by the diode 11 in the conductive state.

For example, it is possible to use the integrated circuit SM P1345-004 produced by Skyworks Solutions Inc., which is internally provided with one pair of diodes 11 according to the diagram shown in FIG. 3.

FIG. 4 shows an alternative embodiment of the electronic power divider 1 according to the invention.

The difference between this version and the circuit illustrated in FIG. 3 lies in that the diodes 11 are of the discrete type.

For example, a possible diode 11 suited to be used in this circuit is represented by the component SM P1345-040 produced by Skyworks Solutions Inc.

The use of discrete diodes 11 can be preferred to the use of integrated components in the case where it is necessary to provide a device 1 capable of minimizing power losses thanks to a reduction of the parasitic effects.

Integrated components, in fact, are usually characterized by a greater loss due to the internal layout of the components.

FIG. 5 schematically shows a different configuration of the device 1 using a single diode 11 (and not a pair of diodes as required, instead, in the configurations illustrated in FIGS. 2 to 4).

In this case, the output $OUT_1$, $OUT_2$, $OUT_3$ is constantly connected to the common point 4 while the diode 11 is connected in parallel with respect to the common point 4 and has the anode 13 facing towards the capacitor 8.

When the diode 11 is interdicted, the signal S present at the input $IN_1$ propagates directly towards the output $OUT_1$, $OUT_2$, $OUT_3$ and therefore the impedance associated with the latter is equal to the lower value $Z_{MIN}$.

However, when the diode 11 is in the conductive state, a conductive path is generated in series with the capacitor 8 and the cascade of the two components generates a modification in the electromagnetic behaviour of the path 3 at the common point 4, actually simulating the insertion of a quarter-wave stub.

In this condition, the impedance associated with the outputs $OUT_1$, $OUT_2$, $OUT_3$ is equal to the higher value $Z_{MAX}$.

Compared to the diagrams shown in FIGS. 3 and 4, the configuration of FIG. 5 reduces the total number of components, is less complex and makes it possible to eliminate the losses introduced by the presence of the intrinsic channel of the diode 11 connected in series to the output $OUT_1$, $OUT_2$, $OUT_3$.

In order to reduce the harmonic phenomena caused by the presence of the diodes 11, it is possible to apply to the latter reverse polarization to a predetermined extent in the state of interdiction.

In the configuration visible in FIG. 6, a continuous and fixed positive potential is applied (for example, equal to 1.5V) at the common point 4, while a pilot potential (which is continuous, too, but variable) is applied to the anode 13 of each diode 11.

The fixed potential is consequently applied also to the cathode 12 of the diode 11, while the pilot potential can assume two values, respectively a low and a high value, which are lower or higher than the constant potential applied at the common point.

For example, the low potential can be close to 0V while the high potential can be close to 3.3V.

When the pilot potential is high, the diode 11 is in the conductive state, while when the pilot potential is low the diode 11 is in the state of interdiction.

However, in this last condition the diode 11 is counter polarized with a potential of −1.5V. Consequently, the diode 11 is certainly in the state of interdiction and, as known, in this operating region the parasitic capacitance curve associated with the component has a substantially linear development.

Therefore, by maintaining the diode 11 in the reverse region, it is possible to foresee its frequency behaviour with higher precision and effectiveness, as the substantial linearity of the parasitic capacitance reduces the risk of generating spurious harmonic signals which may cause the distortion of the electromagnetic signal S.

Furthermore, to further reduce harmonic distortion it is possible to use filtering circuits, for example of the type well known in the existing literature, like notch filters.

These filters make it possible to discharge to earth all the harmonic components present within a predefined operating band, in such a way as to prevent their irradiation in the environment.

The filtering circuits, indicated as a whole by the reference numeral 14, can be directly and electrically connected to each individual output $OUT_1$, $OUT_2$, $OUT_3$ (FIG. 7A), or to the cathode 12 of a possible diode 11 (FIG. 7B) or, again, upstream of the outputs $OUT_1$, $OUT_2$, $OUT_3$ and at the common point 4 (FIG. 7C).

According to a characteristic aspect of the invention, the impedance variation means 7 are configured to maintain the value of the impedance associated with two or more paths 3 at least at the lower value $Z_{MIN}$.

More specifically, the impedance variation means 7 make it possible to selectively maintain the impedance associated with a single output, or with some outputs, or with all the outputs at the lower value $Z_{MIN}$.

Therefore, a power divider 1 for a radio frequency signal according to the present invention and provided with N outputs can maintain the impedance at the lower value $Z_{MIN}$ based on the following combination:

$$\binom{N}{N}+\binom{N}{N\quad 1}+\binom{N}{N\quad 2}+\ +\binom{N}{1}$$

Considering the device illustrated in FIGS. 1 to 9 by way of example, the impedance associated with the outputs $OUT_1$, $OUT_2$, $OUT_3$ can vary according to the following table:

| OUT1 | OUT2 | OUT3 |
|---|---|---|
| $Z_{MAX}$ | $Z_{MAX}$ | $Z_{MAX}$ |
| $Z_{MIN}$ | $Z_{MAX}$ | $Z_{MAX}$ |
| $Z_{MAX}$ | $Z_{MIN}$ | $Z_{MAX}$ |
| $Z_{MAX}$ | $Z_{MAX}$ | $Z_{MIN}$ |
| $Z_{MAX}$ | $Z_{MIN}$ | $Z_{MIN}$ |
| $Z_{MIN}$ | $Z_{MAX}$ | $Z_{MIN}$ |
| $Z_{MIN}$ | $Z_{MIN}$ | $Z_{MAX}$ |
| $Z_{MIN}$ | $Z_{MIN}$ | $Z_{MIN}$ |

The last four lines of the table show the specific characteristic of the impedance variation means 7 in the device 1 which is the subject of the present invention.

In the last four lines the impedance associated with several outputs ($OUT_2$, $OUT_3$)-($OUT_1$, $OUT_3$)-($OUT_1$, $OUT_2$)-($OUT_1$, $OUT_2$, $OUT_3$) is simultaneously equal to the minimum value $Z_{MIN}$, which is not possible in the known power divider circuits, where only a single output at a time can be selectively adapted to the respective load in terms of power.

FIG. 8 and FIG. 9 show a possible actual embodiment of the power divider 1 according to the invention.

In this case, there is a printed circuit 15 provided with four inputs $IN_1$, $IN_2$, $IN_3$, $IN_4$ and twelve outputs $OUT_1$, . . . , $OUT_{12}$.

In this example only eight outputs out of the twelve available outputs are used and at these outputs and at the four inputs there are coaxial connectors 16.

Similarly to what has already been described with reference to the diagrams shown in FIGS. 1 to 7C, each input $IN_1$, . . . , $IN_4$ is connected to three outputs ($OUT_1$, $OUT_2$, $OUT_3$)-($OUT_4$, $OUT_5$, $OUT_6$)-($OUT_{10}$, $OUT_{11}$, $OUT_{12}$) through respective electric paths 3.

The electric paths 3 are made with copper tracks 17 and each one of them has a first common section 5 and respective terminal branches 6 connected to the corresponding outputs $OUT_1$, . . . , $OUT_{12}$.

In this case, the impedance variation means 7 comprise, for each path, an integrated SPDT circuit, indicated by the reference numeral 18 and visible in FIG. 9, provided with an input 19 and two outputs 20 and suited to define the switching element 9.

One of the outputs 20 of the integrated circuit 18 is directly connected to the output $OUT_1$, . . . , $OUT_{12}$ of the device 1 (or to the coaxial connector 16) while the other output 20 of the integrated circuit 18 is directly connected to a capacitor 8.

As exhaustively described above, the means 7 for selectively varying the impedance associated with the outputs $OUT_1$, . . . , $OUT_{12}$ are suited to control the condition of the switching circuit 18 (diodes, transistors, integrated circuits etc.) for the purpose of promoting the selective connection of the capacitor 8 to the corresponding electric path 3.

The device 1 can thus comprise an electronic control unit 21, visible in the configuration illustrated in FIG. 8, which is operatively connected to the switching element 9 in such a way as to promote the selective electrical connection of the common point 4 to a respective capacitor 8 and/or to a respective output $OUT_1$, . . . , $OUT_{12}$ associated with the electrical paths 3.

The electronic control unit 21 will thus be configured to selectively control the condition of the diodes 11 through the application of a conduction/interdiction potential to the ends of their terminals 12, 13, or it can be configured to conveniently feed the integrated DPST circuits which may be used in the power divider 1.

The electronic control unit can be used also in the circuit diagrams illustrated in FIGS. 1 to 7B, even if in these diagrams said component was omitted to make it easier to understand how the power divider works.

Figure 10:
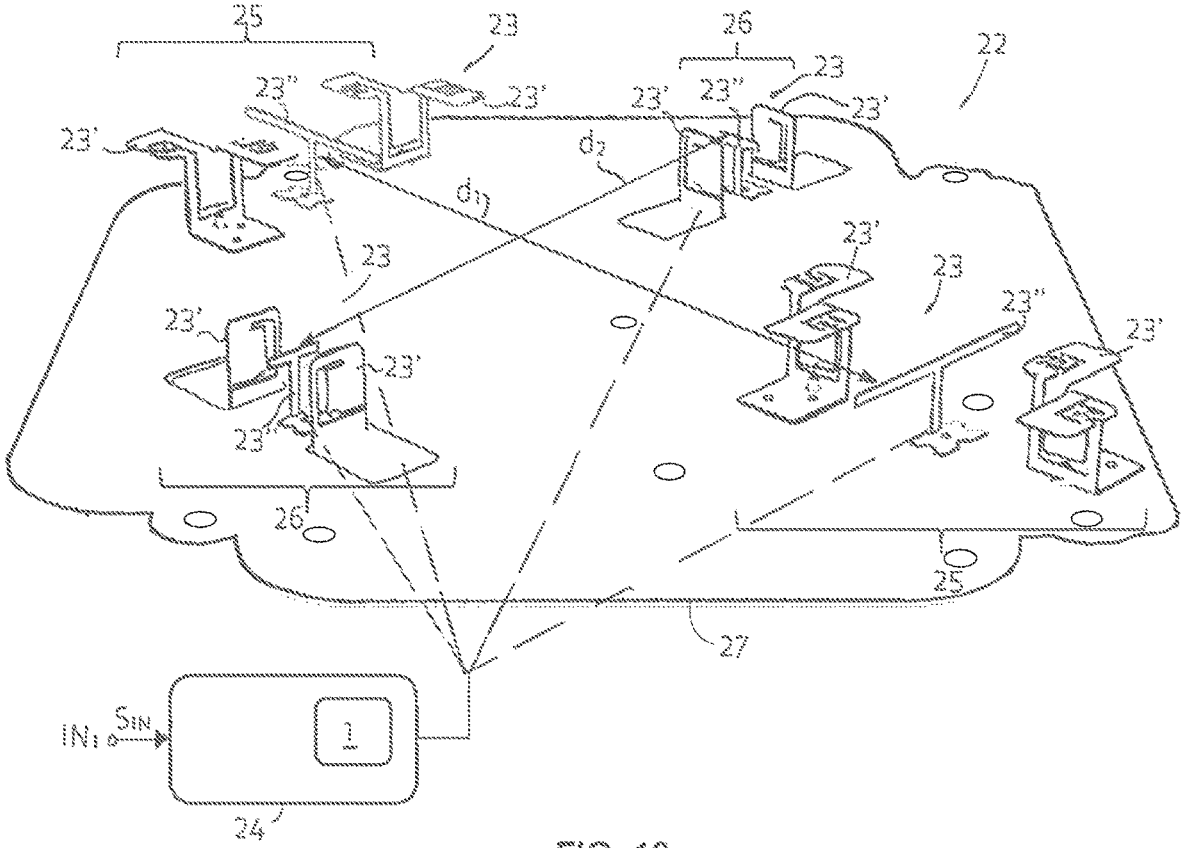
FIG. 10 shows a schematic view of a system for transmitting and receiving an electromagnetic signal provided with an electronic power divider according to the invention.

A possible application of the power divider circuit 1 described above can be constituted by the electronic system 22 for transmitting and receiving electromagnetic signals which is schematically shown in greater detail in FIG. 10 and in FIGS. 11A-11D.

The systems 22 of this type comprise at least two antennas 23 and feeding means 24 suited to promote the feeding of said antennas 22 through a radio frequency signal S having a predetermined wavelength $\lambda$.

In the version of the system illustrated in the Figures there are two pairs (or groups) of antennas 23. The antennas 23 of the first pair (indicated by the reference numeral 25) are suited to transmit/receive a signal with wavelength $\lambda_1$, while the antennas 23 of the second pair (indicated by the reference numeral 26) are suited to transmit/receive a signal with wavelength $\lambda_2<\lambda_1$.

Conveniently, the antennas 23 of each group 25, 26 are spaced from each other by a predetermined distance $d_1$, $d_2$ which is variable according to the wavelength $\lambda_1$, $\lambda_2$ of the radio frequency signal S suited to be transmitted/received.

For example, this distance $d_1$, $d_2$ can be included between a fraction of the wavelength ranging between $0.1\lambda_x$ and $0.8\lambda_x$ and preferably close to $0.5\lambda_x$ (where $\lambda_x$ indicates the specific wavelength of the electromagnetic signal transmitted/received by that specific group 25, 26 of antennas 23).

When fed by the same signal, the antennas 23 can have similar or different radiation patterns. Furthermore, said antennas 23 can have the same or different polarization.

Conveniently, all the antennas 23 can be installed on a metal (or metallized) surface 27.

The antennas 23 can be monopole or dipole antennas configured to halve their effective electrical extension (which corresponds to half the wavelength at the operating frequency) owing to the effect of the electric image constituted by the underlying metallic surface 27.

These antennas 23 can be anchored to the metallic surface by means of welding, punching, application of rivets or other similar connection systems.

Preferably, each antenna 23 is constituted by one pair of radiant elements (indicated in the Figures by the reference numeral 23') having substantially the same shape and spaced by a mutual distance $d_3$ substantially equal to $0.2\lambda_x$.

Each antenna 23 can furthermore be provided with one or more passive elements (indicated in the Figures by the reference numeral 23") interposed between the active radiant elements 23'.

The feeding means 24 are suited to feed the active radiant elements 23' of each antenna 23, while the passive elements 23" are not fed and their presence has the purpose of promoting a predetermined modification of the radiation pattern associated with each antenna 23.

Advantageously, the feeding means 24 are suited to comprise an electronic power divider 1 for electromagnetic radio frequency signals of the type described above.

More specifically, each output $OUT_1, \ldots, OUT_{12}$ of the power divider 1 can be electrically connected to a corresponding active radiant element 23' of each antenna 23 in order to allow it to be independently fed by the respective electromagnetic signal S with predetermined wavelength $\lambda$.

When the impedance of the output $OUT_1, \ldots, OUT_{12}$ of the power divider 1 is equal to the lower value $Z_{MIN}$, the corresponding active radiant element 23' of the antenna will be actually fed by its electromagnetic signal S in conditions of maximum transfer of power P.

On the contrary, when the impedance value of the output $OUT_1, \ldots, OUT_{12}$ of the power divider 1 is equal to the upper value $Z_{MAX}$, the corresponding radiant element 23' of the antenna 23 will be isolated from the input and therefore in a condition of inactivity (not fed).

The electronic control unit 21 will be programmed to promote the selective activation of each active radiant element 23' (and thus of each group of antennas 23) according to the instant requirements of the system 22.

By varying the number and type of active radiant elements 23' which are active at that moment, it will thus be possible to modify the radiation pattern of the system 22 at that given wavelength $\lambda$.

An example of this operating flexibility is illustrated in FIGS. 11A to 11D.

Figure 11A:
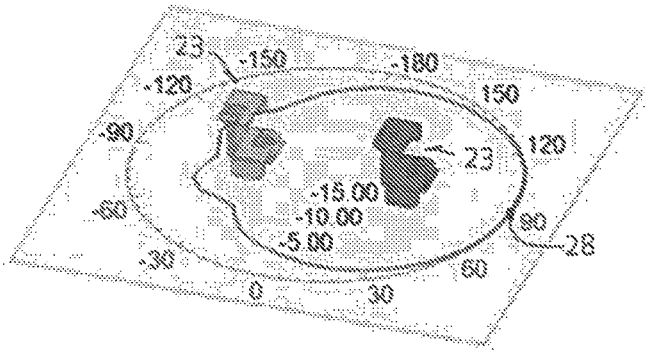
FIGS. 11A to 11D show the radiation patterns associated with respective operating modes of the antennas of the system illustrated in FIG. 10.
Figure 11B:
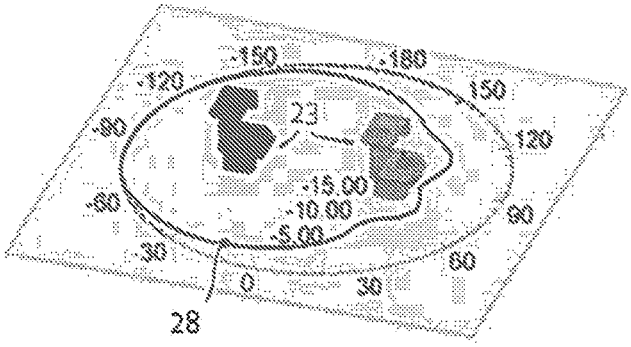
Figure 11C:
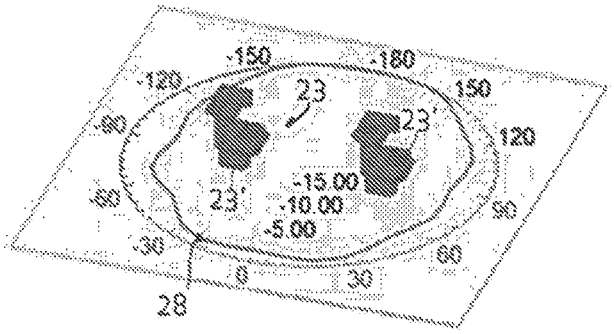

The first three Figures refer to the same group of antennas in three different operating configurations: in FIG. 11A the left radiant element 23' is interdicted (passive) while the right radiant element 23' is active (fed), in FIG. 11B the left radiant element 23' is active while the right radiant element is interdicted and finally in the configuration of FIG. 11C both the radiant elements 23' of the antenna are fed.

The continuous line visible in these figures and indicated by the reference numeral 28 represents the radiation patterns associated with the configurations shown in FIGS. 11A to 11C.

Figure 11D:
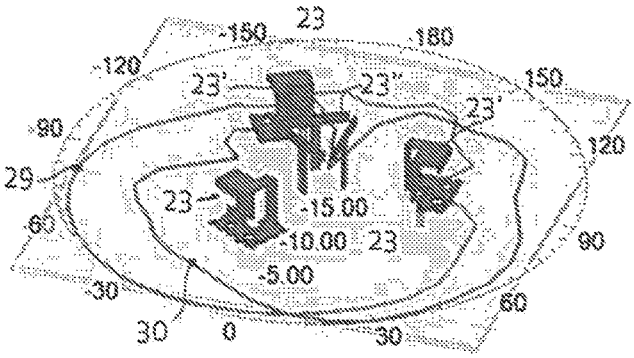

FIG. 11D shows an antenna 23 made up of three radiant elements 23' and three passive elements 23".

In this case, the reference numerals 29 and 30 indicate the lines that represent the radiation pattern associated with the activation of a single radiant element 23' or of a pair of radiant elements 23', respectively.

In general, each radiant element 23' can be classified as a substantially omnidirectional antenna but its radiation pattern can undergo several modifications according to the number of active elements 23' coupled with it which are fed simultaneously.

According to a further configuration of the invention not illustrated in the figures, the antennas 23 can be installed on the same support on which the electronic control unit 21 is installed or on different supports.

In this case the antennas 23 are arranged peripherally with respect to the electronic control unit 21 in such a way as to surround it partially or completely.

These antennas 23 may be connected to the electronic control unit 21 through conductive paths (in the case where they are installed on the same printed circuit as the latter) or through connection cables (if, instead, they are arranged on different supports which are independent of the main printed circuit on which the electronic control unit 21 is installed).

Even in this case the antennas 23 can have the same or different polarization/radiation pattern.

The present invention can be carried out in other variants, all falling within the scope of the inventive characteristics claimed and described herein; these technical features can be replaced by other technically equivalent elements and materials; the invention can have any shape and size, provided that they are compatible with its intended use.

The reference numerals and signs included in the claims and in the description have the purpose of making the text easier to understand and must not be considered as elements intended to limit the technical meaning of the objects or the processes they identify.

The invention claimed is:

1. An electronic power divider (1) for RF signals, comprising:

one or more inputs ($IN_1, \ldots, IN_4$) adapted to be fed by a RF electromagnetic signal (S) having a predetermined wavelength (A);

at least two outputs ($OUT_1, \ldots, OUT_{12}$) for said RF electromagnetic signal (S), each of the outputs being connected to a same input ($IN_1, \ldots, IN_4$);

electric paths (3) arranged to connect each output ($OUT_1, \ldots, OUT_{12}$) to a corresponding input ($IN_1, \ldots, IN_4$); and a system of selective variation of an electric impedance (Z) associated with each of said electric paths (3) during propagation of said RF electromagnetic signal (S) therethrough;

wherein said system of selective variation (7) is designed to vary the electric impedance associated with said electric paths (3) in a discrete manner between two predetermined values, which include a lower ($Z_{MIN}$) and an upper ($Z_{MAX}$) value;

wherein said system of selective variation (7) is designed to simultaneously maintain a value of the electric impedance associated with two or more of said electric paths (3) at least at said lower value ($Z_{MIN}$);

wherein each electric path (3) comprises a first common section (5) having an end connected to one of the one or more inputs ($IN_1, \ldots, IN_4$) and to a common point (4), and a single branch (6) having ends respectively connected to the common point (4) and to a corresponding output ($OUT_1, \ldots, OUT_{12}$); and wherein each single branch (6) of each electric path (3) is electrically isolated from the branches (3) of other electric paths (3).

2. The electronic power divider as claimed in claim 1, wherein the electric paths are three or more electric paths adapted to connect said outputs ($OUT_1, \ldots, OUT_{12}$) to the corresponding input ($IN_1, \ldots, IN_4$), said system of selective variation of the impedance (7) being configured to simultaneously maintain the impedance associated with one or more electric paths (3) at least at said lower value ($Z_{MIN}$) and/or at least at said upper value ($Z_{MAX}$).

3. The electronic power divider as claimed in claim 1, wherein said electric paths (3) have said common point (4), which is electrically connected to said one or more inputs ($IN_1, \ldots, IN_4$).

4. The electronic power divider as claimed in claim 3, wherein, for each electric path (3), said system of selective variation of the electric impedance (7) includes a capacitor (8) connected in parallel to said common point (4) and a switching element (9) configured to selectively connect said common point (4) to said capacitor (8) or to a corresponding output ($OUT_1, \ldots, OUT_{12}$) of said electric path (3).

5. The electronic power divider as claimed in claim 4, wherein said capacitor (8) and said switching element (9) make it possible to set the electric impedance associated with each electric path (3) at said upper value ($Z_{MAX}$) by providing for a modification of an electromagnetic behavior of said electric paths (3), said modification being substantially equivalent to a modification produced by inserting a part of a transmission line of predetermined length and electric impedance at said common point (4).

6. The electronic power divider as claimed in claim 5, wherein said modification of the electromagnetic behavior of each electric path (3) is substantially equivalent to a modification generated by a stub applied at said common point (4), said stub being substantially of a quarter-wave type with respect to a wavelength (1) of said RF electromagnetic signal (S).

7. The electronic power divider as claimed in claim 6, wherein said switching element (9) comprises a pair of diodes (11) connected in parallel to each other and having a cathode (12) electrically connected to said common point (4), one diode (11) of said pair being connected in series to a corresponding output ($OUT_1, \ldots, OUT_{12}$) and another diode (11) of said pair being connected in series to said capacitor (8) to define with said capacitor said stub.

8. The electronic power divider as claimed in claim 5, wherein said switching element (9) comprises transistors.

9. The electronic power divider as claimed in claim 5, wherein said switching element (9) comprises diodes (11).

10. The electronic power divider as claimed in claim 5, wherein said switching element (9) is designed to selectively connect said common point (4) to said output ($OUT_1, \ldots, OUT_{12}$).

11. The electronic power divider as claimed in claim 5, wherein said switching element (9) comprises discrete components and/or integrated circuits.

12. The electronic power divider as claimed in claim 4, further comprising an electronic control unit (21) connected to said switching element (9) to selectively promote an electric connection of said common point (4) to a respective capacitor (8) and/or to a respective output ($OUT_1, \ldots, OUT_{12}$) of said electric paths ($OUT_1, \ldots, OUT_{12}$).

13. An electronic system (22) for transmitting and receiving electromagnetic signals, comprising:

at least two antennas (23); and a supply system (24) adapted to promote an electric supply to said at least two antennas (23) of a RF signal (S) having a predetermined wavelength (A);

wherein said at least two antennas (23) are mutually spaced from each other by a predetermined distance ($d_1$, $d_2$), said predetermined distance ($d_1$, $d_2$) being variable according to the predetermined wavelength (A) of said RF signal (S); and wherein said supply system (24) comprises an electronic power divider (1) for RF signals (S) according to claim 1, said electronic power divider (1) being provided with the one or more inputs ($IN_1, \ldots, IN_4$) for said RF signal and with the at least two outputs ($OUT_1, \ldots, OUT_{12}$) respectively connected to said at least two antennas (23).

* * * * *